United States Patent [19]

Amormino

[11] Patent Number: 4,669,240

[45] Date of Patent: Jun. 2, 1987

[54] PRECAST REINFORCED CONCRETE WALL PANELS AND METHOD OF ERECTING SAME

[76] Inventor: Giuseppe Amormino, 677 Marentette Avenue, Windsor, Ontario, Canada, N9A 1Z3

[21] Appl. No.: 771,822

[22] Filed: Sep. 3, 1985

Related U.S. Application Data

[63] Continuation-in-part of Ser. No. 629,255, Jul. 9, 1984, abandoned.

[51] Int. Cl.[4] ..... E04B 2/28

[52] U.S. Cl. ..... 52/236.6; 52/259; 52/295; 52/309.12; 52/741; 52/405; 52/407; 264/253

[58] Field of Search ..... 52/383, 407, 410, 251, 52/427, 429, 236.3, 236.6, 236.7, 236.8, 259, 426, 432, 602, 303, 405, 295, 309.12, 293, 294; 264/31, 35, 253, 259

[56] References Cited

U.S. PATENT DOCUMENTS

| | | | |
|---|---|---|---|
| 1,060,853 | 5/1913 | Peirce | 52/236.7 X |
| 1,428,470 | 9/1922 | Brainerd | 52/293 X |
| 1,618,696 | 2/1927 | Bemis | 52/236.7 X |
| 1,818,443 | 8/1931 | Wilson . | |
| 2,047,109 | 7/1936 | Nagel | 72/68 |
| 2,213,355 | 9/1940 | Woodworth | 72/16 |
| 3,336,709 | 8/1967 | Berney et al. | 52/407 X |
| 3,559,355 | 2/1971 | Day, Jr. | 52/383 X |
| 3,772,840 | 11/1973 | Hala | 52/410 X |
| 4,104,842 | 8/1978 | Rockstead et al. | 52/383 X |
| 4,236,364 | 12/1980 | Larsson et al. | 52/383 |
| 4,359,848 | 11/1982 | Haeussler | 52/405 |

FOREIGN PATENT DOCUMENTS

| | | | |
|---|---|---|---|
| 2021192 | 4/1972 | Fed. Rep. of Germany . | |
| 1188262 | 3/1959 | France | 52/236.3 |
| 2509441 | 1/1983 | France | 52/303 |
| 520 | 8/1979 | World Int. Prop. O. | 52/259 |
| 8102910 | 10/1981 | PCT Int'l Appl. . | |
| 212477 | 3/1924 | United Kingdom | 52/259 |

*Primary Examiner*—John E. Murtagh

*Attorney, Agent, or Firm*—Cullen, Sloman, Cantor, Grauer, Scott & Rutherford

[57] ABSTRACT

A precast panel for a building comprises a pair of molded concrete inner and outer panel elements with a steel wire mesh embedded throughout each panel element. A series of laterally spaced continuous steel rod trusses are interposed between and extend at right angles to the panel elements with end portions of the trusses embedded into the panel elements. An insulating layer overlies and is bonded to the interior side of the outer panel element occupying part of the space between the panel elements, the remainder of the space providing an air barrier zone. Pairs of aligned panels and right angularly related corner panels are interconnected by a concrete column poured in situ between the adjacent panels. A method of making the building panel includes the steps of assembling and interconnecting a series of wire trusses between a pair of wire mesh reinforcements forming a reinforcement member, supporting the reinforcement member upon a first mold, pouring concrete into the mold to enclose one steel wire mesh reinforcement and the one edge portions of the trusses, and curing to form a reinforced inner panel element with one of the wire mesh and portions of the trusses embedded therein. Further steps include applying and bonding a series of strips of insulating material between the trusses in a plane spaced from the inner panel element and mounting the inner panel element, reinforcement and insulating strips horizontally with the insulating strips forming the bottom of a second mold and successively pouring concrete into the second mold enclosing the other wire mesh reinforcement and other edge portions of the trusses and curing to provide a unit building panel.

6 Claims, 9 Drawing Figures

PRECAST REINFORCED CONCRETE WALL PANELS AND METHOD OF ERECTING SAME

This patent application is a continuation-in-part of my copending U.S. patent application, Ser. No. 06/629,255, filed July 9, 1984, entitled "Precast Reinforced Concrete Panels", now abandoned.

This invention relates to precast reinforced concrete construction of bearing, retaining and curtain walls and including wall panels erected side by side together with the method of making and erecting said panels for a building construction.

BACKGROUND OF THE INVENTION

Precast concrete wall panels are commonly used as architectural non-bearing curtain walls in residential, commercial, and industrial buildings for their appearance and insulation qualities. However, some architectural precast wall panels are designed to function as bearing or retaining walls as well.

Existing precast concrete wall panels have either solid or sandwich sections. However, the latter are more commonly used due to their light weight and insulation characteristics.

Sandwich panels are produced in many different forms and configurations aiming at the optimization of strength, weight and cost factors to achieve a structurally and economically sound panel. The sandwich wall panel derives its bearing capacity for compression and/or bending from the individual capacities of the different section elements and the composite action of these elements provided that the are enough shear connectors between them capable of transferring the shear forces without exhibiting appreciable slippage between the separate layers. This can usually be achieved by using the insulating core material as a medium transmitting the shear flow or by providing the section with metallic shear connectors of different shapes and configurations.

THE PRIOR ART

Examples of concrete reinforced structural panels are shown in one or more of the following U.S. and Foreign Patents considered in the earlier filed patent application:

No. 1,818,443; 8/11/31; W. H. Wilson
No. 2,047,109; 7/1/36; G. E. Nagel
No. 2,213,355; 9/3/40; R. D. Woodworth
No. 4,359,848; 11/23/82; Ernst Haeussler
German No. 2,021,192; 4/30/70; W. A. Shuckmann
PCT WO 81/02910; 10/15/81; Denzer et al

SUMMARY OF THE INVENTION

An important feature of the present invention is to provide a wall panel in the form of a structural sandwich panel consisting of two layers of steel reinforced concrete connected by galvanized steel trusses made of special reinforcing steel rods. The gap between the two concrete layers is partially filled with a layer of rigid insulation in direct contact with the outer concrete layer leaving the rest of the gap for air circulation inside the wall section. The inner concrete layer is thickened at the top of the panel to provide a sufficient bearing surface for the different floor or roof elements to be supported by the panel. The panels connect to each other vertically by cast in situ concrete pillars located at the junction between adjacent panels.

As a further feature the two concrete layers are reinforced by welded wire meshes of appropriate size and spacing to achieve the strength and code requirements for minimum reinforcement.

Another feature is to provide a ventilated wall panel which is modular, precast and architectually finished that effectively combines aesthetics, strength, energy conservation and economy.

Another feature, the exterior of the panels is adapted to receive different architectural finishes such as concrete textured surfaces, fine stone finish, stucco finish, thin brick veneer and thin stone veneer. The panels have a smooth interior surface that need not be finished. However, the panel surfaces can be plastered, directly painted or wall papered.

Another feature is to provide panels having adequate strength for supporting a floor and roof construction as well as retaining earth. These panels do not require additional structural supports as in the case of architectural curtain walls, thus offering significant saving in material and labor.

A further feature is to provide a space between the exterior and interior concrete layers of the panels large enough to accommodate variable thicknesses of rigid insulation to offer the desired R value according to the design of the building and its locality.

A further feature includes providing an air space between the concrete layers which improves the insulating characteristics of the wall panel, and can be used for plumbing pipes and electrical wiring.

As another feature, air circulation will be maintained throughout the length and height of the wall panels by connecting the air spaces in adjacent panels and throughout the different stories of the building. Thus, the panels will be thoroughly ventilated eliminating any moisture penetrating the interior surface of the wall.

A further feature includes an insulation which envelopes the entire exterior of the building and connects to the roof insulation thus minimizing heat losses through cold bridges.

A further feature includes poured in situ concrete at the vertical joints between adjacent panels and including corner panels, and horizontal joints between consecutive floors which connect the precast panels by means of steel dowels to a monolithically poured concrete grid.

An important feature is to provide for a unit precast panel molded concrete inner and outer panel elements of rectangular shape with a steel wire mesh reinforcing member embedded into and throughout each panel element, and a series of parallel laterally spaced continuous steel wire trusses or shear connectors which are interposed between, embedded into, and extend at right angles to the panel elements, and with the wire mesh reinforcing members and the trusses interconnected to form a unit reinforcement.

Another feature is to provide a fiberglass insulating layer, or other known equivalent insulator which overlies and is bonded to the interior surface of the outer panel element so as to occupy part of the space between the panel elements and with the remaining space providing an air barrier or zone between panel elements and adapted to accommodate wiring and plumbing conduits.

These and other features and objects will be seen from the following specification and claims in conjunction with the appended drawings.

THE DRAWINGS

It will be understood that the above drawings illustrate merely a preferred embodiment of the invention and the steps of the present method and that other embodiments and steps are contemplated within the scope of the claims hereafter set forth.

DETAILED DESCRIPTION OF AN EMBODIMENT OF THE INVENTION

Figure 1:
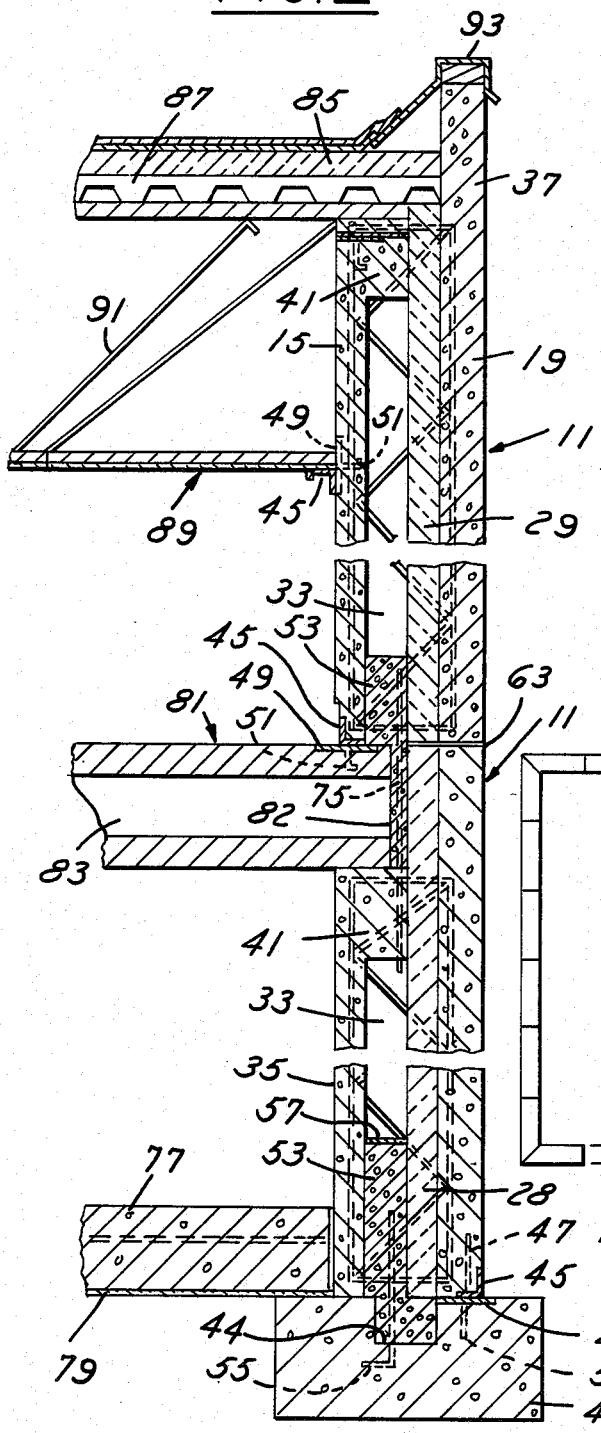
FIG. 1 is a fragmentary vertical section of a portion of a building construction illustrating assembly of a pair of vertically aligned wall panels, flooring and ceiling.

Referring to the drawings, the present precast building panel 11 is shown as a part of a building wall 13 for a building in FIG. 1, and includes a cast concrete inner panel element 15 of rectangular shape, 50 mm thick, for illustration. Embedded within panel element 15 is a welded steel wire mesh reinforcement 17, generally rectangular in shape corresponding to the shape of inside the panel element.

Figure 3:
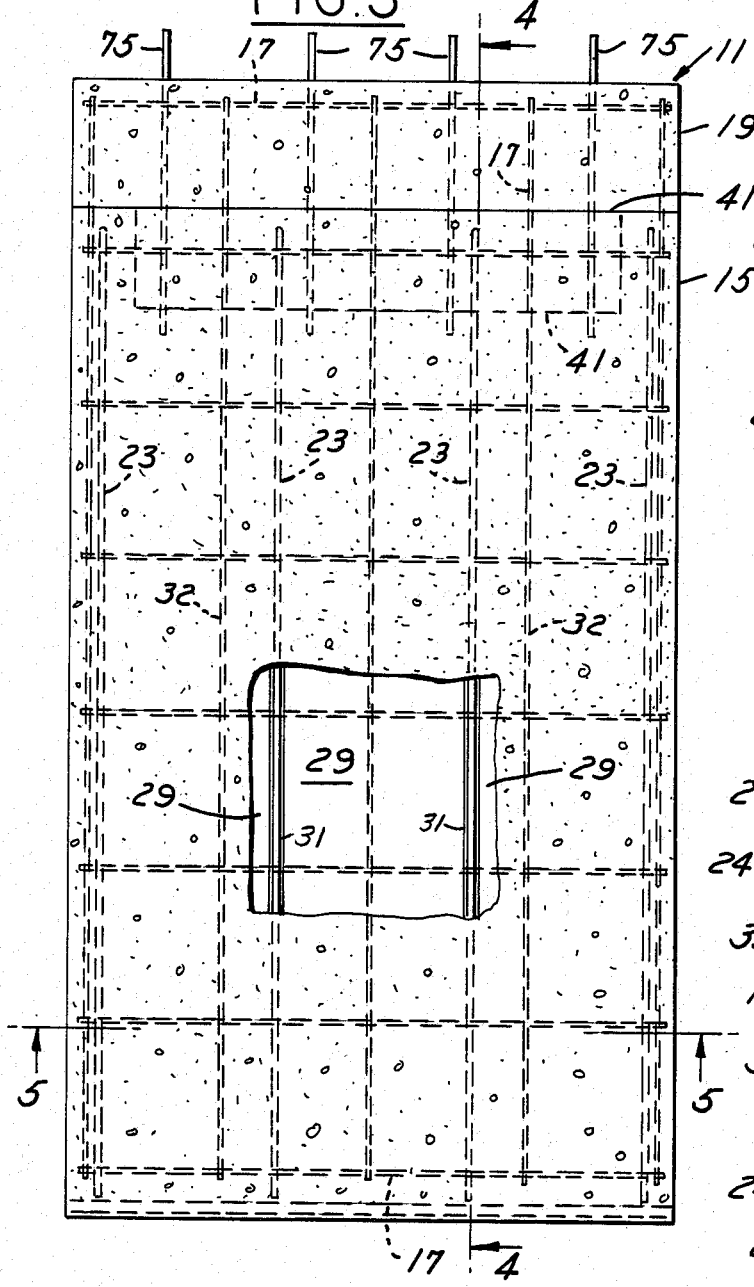
FIG. 3 is a partly broken away front elevational view of a building panel.
Figure 4:
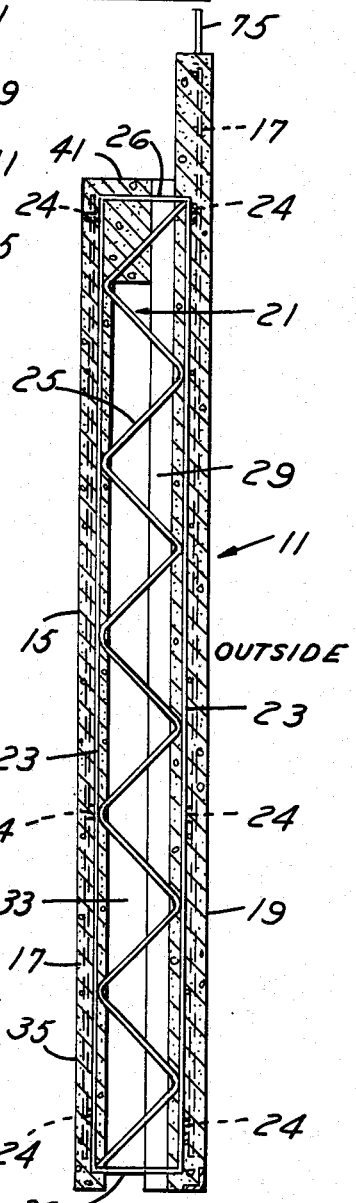
FIG. 4 is a vertical section taken in the direction of arrows 4—4 of FIG. 3.

Precast panel 11 includes an assembled outside or outer cast concrete panel element 19, FIGS. 3 and 4, of similar rectangular shape. Interposed between and embedded into the respective inside and outside panels are a series of parallel laterally spaced steel rod trusses 21, fragmentarily shown in perspective in FIG. 6, sometimes referred to as shear connectors. The outside concrete panel element 19 in the illustrative embodiment is 60 mm in thickness. The respective laterally spaced trusses 21 each include a pair of parallel spaced rods 23 of galvanized steel, 10 mm in diameter, for illustration, which are connected to the corresponding wire mesh reinforcement 17 as by the welds 24, FIG. 4.

For each of the steel trusses 21 in between the spaced rods 23, there is provided a continuous zig-zag steel truss element defined by a series of angularly related bars 25, sometimes referred to as shear transfer bars. These bars are part of a single bent zig-zag truss element or are individually positioned and welded at 27, FIG. 6, to the corresponding rods 23. Each of the respective trusses have top and bottom connectors 26, FIG. 4, suitably welded to the adjacent rods 23.

Figure 6:
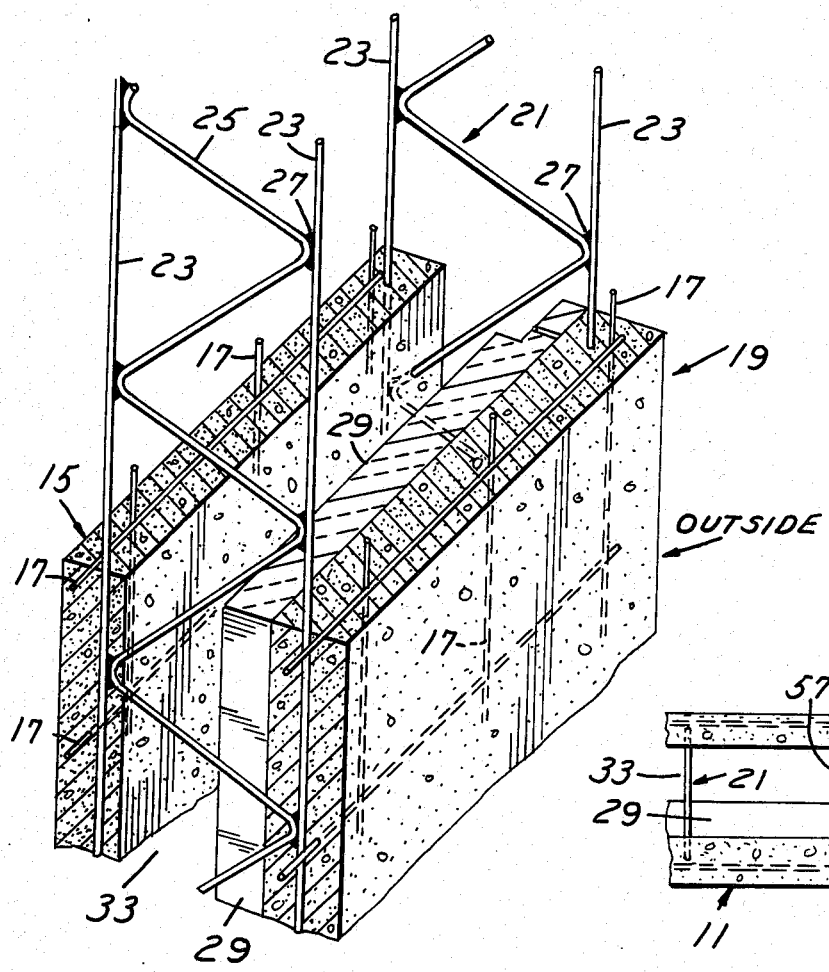
FIG. 6 is a fragmentary perspective view of a portion of a building panel illustrating the steel wire mesh reinforcement and interconnecting trusses.

The zig-zag truss elements 25 may be formed of continuous wire properly bent as shown in FIG. 6 as a unit and welded at the corresponding apexes 27 to adjacent rods 23.

The corresponding apexes formed a part of the zig-zag truss element 25 are respectively embedded into and anchored within the corresponding inner and outer panel elements 15 and 19, FIGS. 1, 3, 4, 5 and 6. Each of the corresponding welds 27 are embedded within the precast concrete panels.

The outer concrete panel element 19 has embedded therein a second welded wire mesh reinforcement 17, FIG. 6, which extends over the length and width of the panel element. The corresponding wire mesh reinforcements 17 lie in parallel planes and are arranged outwardly of the laterally spaced trusses 21 and are secured thereto as by welding at 24 to provide a unit reinforcement.

Upon the interior of the outer panel element 19, there is applied insulation layer 29, generally rectangular in shape, suitably bonded or otherwise secured to the outer panel element 19. In the illustrative embodiment, in FIG. 3, applied to the inner surface of the outer panel element 19, are a series of laterally spaced elongated panel insulation strips 29 arranged side by side and interposed between adjacent pairs of trusses 21. The thickness of the insulation layer is 100 mm (4").

The respective strips of insulating material are of fiberglass, for illustration, and have applied to their outer edges a suitable resin or adhesive material which bears against adjacent portions of the corresponding trusses 21 for securing thereto. The spacing 31 between adjacent insulation strips 29 is filled by a suitable grout 32 or other insulation material FIG. 3. The respective insulation fiberglass panel strips 29 are initially, in the method hereafter set forth, mounted between the respective pairs of trusses 21 and bonded thereto by a suitable resin. The fiberglass insulation panel strips or layer 29 are generally rectangular in shape and overlie substantially the entire interior area of outer panel element 19.

The insulation layer 29 fills a part of the air gap or air space between the inner and outer panels. The remaining space provides an air barrier zone 33 which is approximately 10 mm wide, for illustration. The air barrier zone serves as a further insulator between the panel elements 17 and 19 and is also used to accommodate wiring and plumbing conduits.

Figure 9:
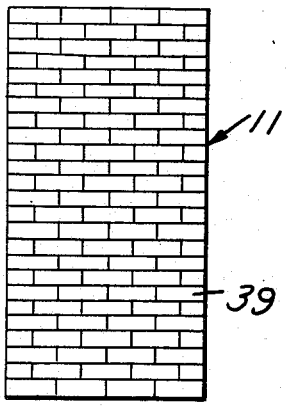
FIG. 9 is a front elevational view of a panel on a reduced scale to which there has been applied a brick facing.

The inner panel element 15 is formed in a steel mold and has an inner facing 35 which is smooth for use as is or to which paint or wallpaper or plaster may be applied. The outside facing 37 of the outer panel element 19 can have different architectural finishes applied thereto such as a concrete textured surface, a fine stone finish, a stucco finish, a thin brick veneer such as shown at 39, FIG. 9, or a thin stone veneer. In the illustrative embodiment, the thin brick veneer facing 39 is ½" thick.

The upper end of the inner panel element 15, FIGS. 1, 3 and 4, has an inwardly directed end support flange 41 which extends laterally outward into engagement with insulation layer 29 of the outer panel element. The corresponding end portion of the outer panel element extends outwardly beyond support flange 41 for a distance sufficient to accommodate the right angularly related floor panel or slab 81, FIG. 1.

In the concrete casting of the inner panel element includng the end support flange 41, a series of laterally spaced steel dowels 75 are cast into and anchored through end support flange 41 and project outwardly, FIGS. 1 and 3.

The series of walls 13 for a building or the like consist of a series of laterally aligned unit precast panel elements 11 arranged side by side and mounted and supported and anchored to the underlying continuous concrete cast footing 43, FIG. 1. The footing 43 is normally below the ground surface a predetermined amount, depending upon whether there is to be a full basement or a limited crawl space beneath the building.

Footing 43, generally rectangular in cross-section, has a continuous elongated top slot 44. Cast into the outside lower corner of the respective outer panel element 19 is a steel protective angle 45 which extends throughout its width and is embedded within the outer panel element 19, FIG. 1. A series of upright laterally spaced dowels 47 similar to the dowel arrangement in FIG. 3, are welded to angle 45 along its length and are embedded within the cast concrete forming a part of the outer panel element.

Dowel mount plate 49 is cast into footing 43 and includes welded thereto a depending series of laterally spaced reinforcing steel dowels 51.

Adjacent to the bottom of air space or zone 33 within the upright panel 11 as shown in FIG. 1, there is a base plate concrete horizontal connector 53 which consists of concrete which has been poured in situ into the lower space 33 between the inner and outer panel elements 15, 19 and extends down into footing slot 44. Also formed within footing 43, as cast, are a series of laterally spaced upright dowels 55 which project up into zone 33 so as to be embedded and anchored into the poured horizontal concrete connector 53 and cured. Suitable lathing 57 overlies connector 53. The lath may be constructed of styrofoam, plywood, or metal, and overlies the horizontal connector or joint between panel 11 and the underlying footing 43.

In the illustrative embodiment, this construction provides a means by which the respective laterally aligned wall panels or other panels 11 are arranged side by side upon footing 43 around its perimeter, with a horizontal joint provided which extends between the lower ends of the corresponding panels and footing 43 and interlocked therewith.

Figure 7:
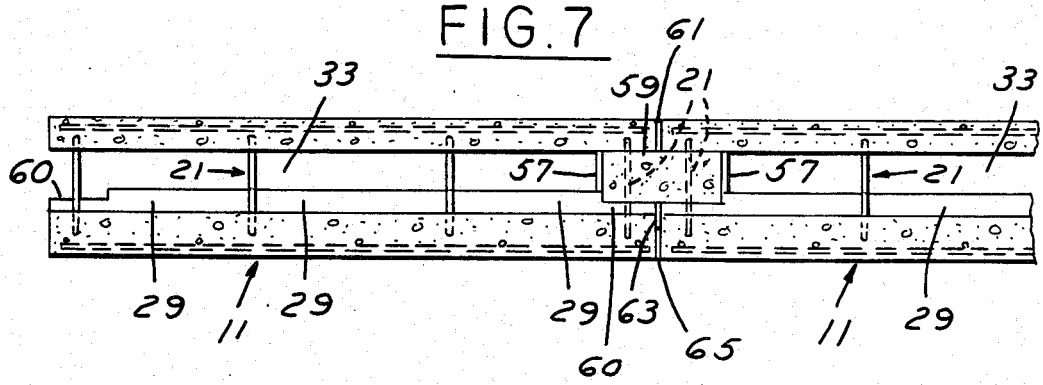
FIG. 7 is a fragmentary plan view based upon the circular inset applied to FIG. 2, on an increased scale.

A suitable vertical connector or panel column 59 is interposed between adjacent pairs of closely spaced panels 11, FIG. 7. Upon assembly of an adjacent pair of closely spaced wall panels 11 upon the footing 43, the vertical joint between adjacent panels is completed by applying to the respective panels 11 adjacent and along their inner edges and throughout their height a pair of laterally spaced laths 57. They extend down to the footing and define a chamber into which is poured in situ a concrete column throughout the height thereof. When cured, there is provided a reinforcing vertical column 59 for the building construction and particularly for interconnecting and supporting the adjacent panels 11, FIG. 7.

The outer trusses 21 of the corresponding steel reinforced adjacent panels extend into the chamber between the laterally spaced laths 57 and are embedded into the panel connector column 59 when fully cured. The concrete for columns 59 is poured in situ as a pair of adjacent panels are erected upon footing 43, FIGS. 1 and 7.

Figure 5:
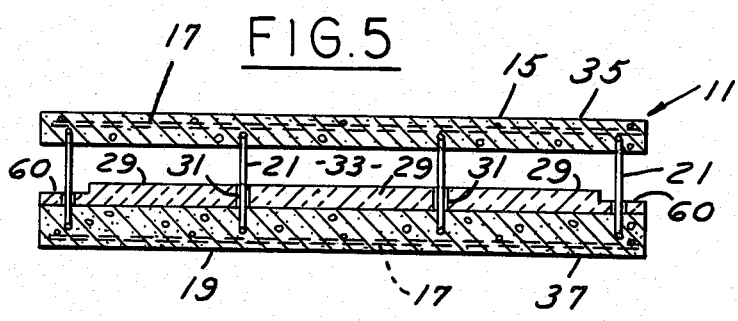
FIG. 5 is a transverse section taken in the direction of arrows 5—5 of FIG. 3.

As shown in FIGS. 4, 5 and 7, the outer most of the insulated panel strips 29 have column clearance flanges 60 adjacent their outer edges so that the concrete column 59 when poured nests into the notch defined within the adjacent insulated panel and interlocks therewith on curing.

Figure 2:
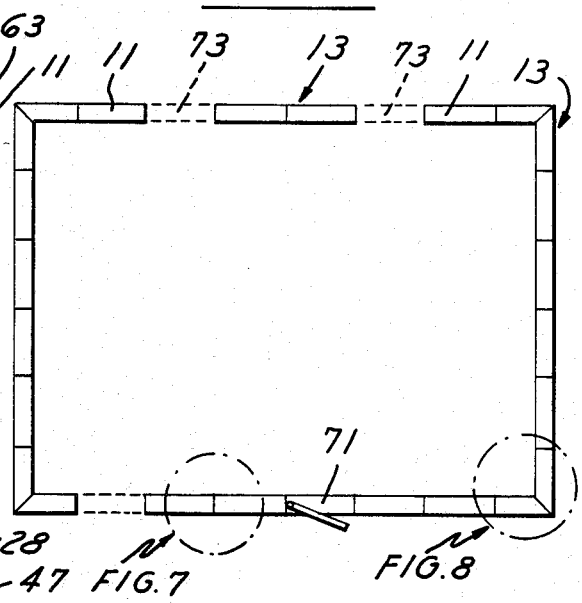
FIG. 2 is a schematic plan view of a building having a series of walls utilizing the present panels.

While a pair of panels forming wall 13, FIG. 2, are in lateral alignment, they are closely spaced defining a limited spacing 61 between their corresponding upright edges. Upright elongated shim strip 63, preferably of steel, is interposed between adjacent portions of the panels outwardly of column 59. A suitable sealant or exterior caulking 65 furthermore fills the spacing 61 between the adjacent upright edges of the panels throughout their height. The concrete used in completing the column 59, is referred to as "a high slump concrete mix" to avoid segregation of the mix components until the concrete has cured over a period of time and sufficiently hardened.

Figure 8:
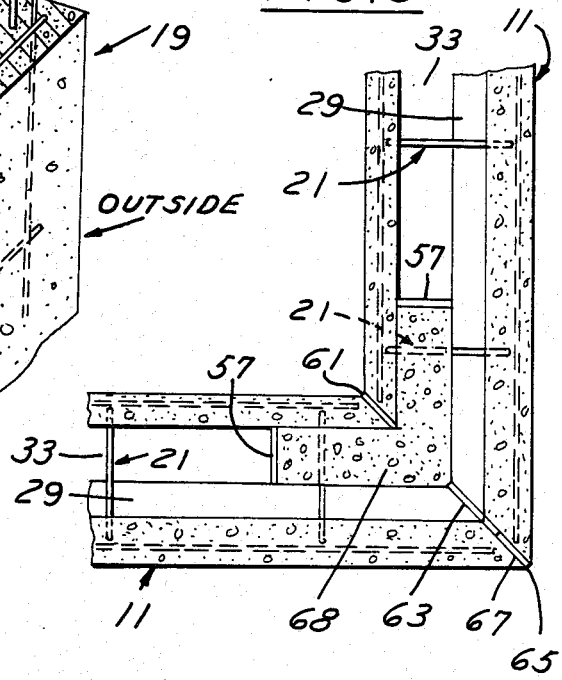
FIG. 8 is a fragmentary plan view of a pair of corner panels based upon the circular inset applied to FIG. 2.

The building schematically shown in FIG. 2 includes right angularly related walls 13. In FIG. 8 on an increased scale, there is shown a pair of right angularly related corner panels 11 which are mitered at 67 throughout their height and are closely spaced apart defining upright spacing 61, at the adjacent mitered corners 67. An elongated steel shim 63 is interposed between adjacent mitered portions 67 of the corner panels throughout their height. The vertical column 68 interconnects the corner panels 11 and is poured in situ.

Before pouring, there are provided within the adjacent corner panel elements, FIG. 8, a pair of upright angularly related laths 57, which may be of styrofoam, plywood or metal. These are arranged inwardly of the mitered corners 67 of the adjacent panels and extend at right angles to the corresponding inner and outer panel elements of the respective panels.

The laths extend down into the footings and define with the interior surfaces of the panel elements 15 and 19 a chamber into which the column of concrete 68 is poured in situ throughout the height thereof. The outermost trusses 21 or shear connectors of the adjacent right angular related panels are embedded within the concrete poured column 68 to reinforce the column when cured. This provides a vertical connector joint for the adjacent corner panels, fragmentarily shown in FIG. 8.

As a part of the erection of a building, such as shown in FIG. 2, including a series of aligned and right angularly related upright wall panels 11, there is provided a suitable door opening 71 and a plurality of window openings 73.

A suitable flooring such as a precast concrete floor slab 77 is arranged horizontally so as to be supported at one end upon footing 43. The slab 77 may have upon and along its undersurface a suitable insulation sheet 79. It is considered as equivalent that instead of the cast steel reinforced floor slab 77, there could be employed in a horizontal position wall panels 11.

In the erection of a building, fragmentarily in FIG. 1, there is provided a floor panel or concrete slab 81 having an air space 83 which at one end extends over and is mounted upon wall panel 11 overlying the end support flange 41 of the inner wall panel element 15 and suitably secured thereto.

It is contemplated as equivalent that the flooring 81 may be one of the wall panels 11, otherwise supported and at the end, where shown, overlies and is mounted upon the upright erected wall panel 11 and is of the same lateral width.

In the illustrative embodiment, the building construction contemplates the use of a second wall panel 11 vertically aligned with and supported upon the initial wall panel 11, FIG. 1, and suitably anchored thereon. The air zone 33 of the upper panel 11 is in communication with the air zone 33 of the lower panel to improve the ventilation within the assembled wall defined by the series of pairs of vertically aligned and interconnected panels 11. As desired, a leveling metallic shim 63 may be interposed between the vertically aligned panels 11.

The connection may otherwise be closed by a suitable sealant or other material to seal the wall construction.

There is provided between the vertically aligned panels 11 a vertical poured concrete joint 53 similar to the joint 53 described for anchoring the lower-most panel upon footing 43. On erection of the second vertically aligned wall panel 11 over the first wall panel, the respective reinforcement steel dowels 75 which are embedded within the lower wall panel and particularly through the support flange 41 project up into the air zone 33 between the inner and outer panel elements 15 and 19 of the upper-most panel shown in FIG. 1.

Concrete is poured in situ into the zone 33 at the lower end of the upper most wall panel at 53 so as to enclose end portions of dowels 75 with portions of the concrete passing downwardly as at 82 adjacent one end of flooring 81 further embedding the corresponding laterally spaced dowels 75. This defines when cured, an effective vertical joint between the respective upper and lower panel elements and adjacent flooring 81.

The inner concrete panel elements 15 are thickened at the top as at 41 to provide sufficient bearing surface for the floor or roof elements shown in FIG. 1. The respective panels 11 are connected to each other vertically by cast in situ concrete columns 59 located at the junction between adjacent panels 11 and including the corner columns 68 between the junction of a pair of adjacent right angularly related wall panels, FIG. 8.

The respective inner and outer panel elements 15 and 19 are reinforced by the welded wire mesh 17. Sandwiched between the wire meshes 17 for the respective panel elements are the corresponding series of laterally spaced parallel trusses or shear connectors 21. These are suitably intergrated and secured to the wire mesh 17 of the respective panel elements as by a series of connectors or welds at 24, FIG. 4. Thus, the concrete inner and outer panel elements are suitably reinforced by the welded wire meshes 17. There is provided between the respective inner and outer panel elements the series of laterally related parallel steel trusses 21, These interconnect the corresponding inner and outer panels and are embedded and anchored thereinto at their apexes 27, FIG. 6.

The ventilated wall panels 11 are modular, precast, architecturally finished structural wall panels that effectively combine aesthetics, strength, energy conservation and economy.

The flooring 81 could be a unit concrete reinforced slab or one of the panels 11 designated 81 having an insulating air space 83. In the assembly in FIG. 1 of the panel 81 or floor slab there is embedded a laterally extending dowel mount plate 49 underlying the corresponding angle 45 cast upon the upper panel element.

A series of laterally spaced steel dowels 51, of L shape in the illustrative embodiment, depend from dowel mount plate 49 and are embedded within the cast slab 81. This completes the anchoring and reinforcement of the upper panel 11 aligned with and located upon the lower panel in FIG. 1.

Fragmentarily shown in FIG. 1 there is provided a roof panel 85 which may be of the same construction as the panel 11. Roof panel 85 has depending therefrom an insulator 87 which may correspond to and be similar to insulation layer 29 made of fiberglass or equivalent insulating material.

One end of the roof panel 85 overlies the top wall panel 11 and particularly is supported upon the end support flange 41 which extends laterally across an upper end portion of the inner panel element 15 and is suitably secured thereto. The outer panel element 19 extends above roof panel 85 and has connected thereto a suitable protective galvanized steel cap 93. Such cap normally extends peripherally around the entire top surface of the adjacent and interconnected wall panels 11 defining the building walls, FIG. 2.

In the illustrative embodiment, there is shown schematically a drop ceiling 89 supported upon the angle or bracket 45 which extends from the adjacent dowel mount plate 49 as a means of supporting the perimeter outer edge portions of the ceiling assembly 89. Suitable wire supports 91 suspend portions of the ceiling 89 from the overlying roof assembly 85.

THE METHOD OF MAKING A PANEL

The present invention further includes the method of making a building panel which includes a following steps:

Assembling and interconnecting by welding a series of parallel laterally spaced steel rod trusses 21 between and at right angles to a pair of parallel steel wire mesh reinforcing members 17 to provide a unit panel reinforcement.

Successively mounting and supporting the reinforcement horizontally upon and above an elongated rectangular mold of such shape and depth as to provide for the molding of the inner panel element 15.

Successively pouring concrete into the mold to a depth sufficient to enclose one of the steel wire meshes 17 and the corresponding adjacent edge portions of the assembled trusses 21. This would include the adjacent steel rods 23 and the adjacent welded apexes of the corresponding trusses 21.

This is followed by the steps of curing or hardening the concrete to form a steel reinforced inner panel element 15 having the trusses upon one side thereof along their length and one of the wire mesh reinforcing members 17 embedded and anchored therein.

As a further step, a layer of insulating material is applied to the truss assembly. This is accomplished by applying a series of strips 29 of suitable insulating material, as for example fiberglass, between each pair of the trusses 21 side by side as shown in FIG. 3. The strips when assembled are arranged in a plane which is spaced from the inner panel element. Before insertion of the strips of insulating material at 29, there corresponding edges have applied thereto a suitable adhesive or bonding agent or resin so that upon assembly within and between the respective trusses 21 the panels will adhere to adjacent portions of the trusses and be bonded thereto.

The assembled and cast inner panel element 15, the reinforcement and the insulating strips 29 which are temporarily supported by a series of wood blocks, for illustration, are then arranged in a horizontal position with the reinforcement extending upwardly. In such a position, the insulating strips define the bottom wall of a suitable rectangular mold into which the outer panel element 19 is to be poured.

A further step includes the pouring of a concrete mix into the second mold to such depth as to overlie the insulating strips 29 and to enclose apex portions o the adjacent trusses where they are welded as at 27 and to further enclose the adjacent steel rods 23 and of sufficient depth as to form when cured the outer panel element 19, fragmentarily shown in FIG. 6.

After pouring, the concrete is cured to permit hardening of the concrete to form the steel reinforced insulated outer panel element 19 which has embedded therein outer edge portions of the corresponding trusses along their lengths, and the other steel wire mesh 17.

Upon curing, the finished wall panel is separated from the second mold as a unit modular panel 11 such as would be used in the construction of the building fragmentarily shown in FIGS. 1 and 2.

As a further step in connection with the assembly and securing of the insulating strips within the reinforcement and between the respective pairs of trusses 21, spacing 31 between the adjacent strips 29 required because of the thickness of the respective trusses is filled with a suitable filler, epoxy or other insulating material. When sealed, the laterally aligned planer insulating strips define the bottom surface for the casting mold for the outer panel element 19.

During pouring and curing of the concrete upon the layer of temporarily supported insulator strips 29, interior portions of the outer panel element 19 adhere to or are otherwise bonded to the insulating layer 29 or series of strips of insulating material.

METHOD OF ERECTING A BUILDING

Once the unit wall panels 11 have been cast, they are mounted upon a suitably previously cured concrete footing 43, FIG. 1. A further step in erecting of the building includes assembling laterally spaced laths 57, of styrofoam, plywood or metal, between and at right angles of the panel elements 15 and 19 of the adjacent panels, FIG. 7, inwardly of the outer edges of each panel to define a chamber between the laths including the air zone 33 within the panels.

A further step includes pouring in situ into the chamber down to the footing 43 a column 59 of concrete to the height of the respective panels. Portions of the outermost trusses 21 extend into and are embedded within concrete column 59. Concrete for the column extends into the footing channel 44.

The final step includes curing the column of concrete for a time sufficient for hardening with a column of cement reinforced by the truss portions 21 and interconnecting the panels 11 and the corresponding panel elements throughout their height. The column 59 interlocks with the footing 43.

The respective columns 59 form the vertical joints between adjacent aligned panels 11 forming a part of the building structure, FIG. 2.

Part of the present method includes forming of vertical concrete columns 68 between corner panel elements as fragmentarily shown in FIG. 8. This includes the assembling of a pair of right angularly related panels having adjacent mitered edges 67 along their length which are closely spaced apart and form a corner for a pair of right angularly related building walls.

A further step includes assembling laterally spaced right angularly related laths 57 between and at right angles to the respective panel elements of each pair of panels inwardly of the outer edges of each panel to define a chamber along with the interior walls of the inner and outer panel elements, FIG. 8.

A further step includes pouring in situ into the chamber down to the footing 43 concrete to the height of the corner panels. Portions of the trusses 21 are embedded within column 68. The column 68 interlocks with footing 43.

A further step includes curing pf the column of concrete. The column 68 is reinforced by the trusses 21 and interconnects the corner panels and the panel elements throughout their height.

A study was conducted on the insulation properties of the panels 11 at the University of Western Ontario, London, Canada which shows the insulation qualities of the panels to be satisfactory for all normal function buildings whether residential, commercial, instilational or industrial. The following is a summary of the expected inside wall surface temperatures (°F.) for the panels.

| $T_{outside}$ (°F.) | $T_{wall\ inside}$ with no insulation (°F.) | $T_{wall\ inside}$ with insulation (°F.) |
|---|---|---|
| 20 | 42.6 | 68.5 |
| 10 | 37.2 | 68.2 |
| 0 | 31.6 | 67.8 |
| −10 | 26.2 | 67.6 |

The calculations assumed in the following:

(i) The "R" value of "SM Blue" insulation is 5/inch.

(ii) The inside film coefficient has an "R" value of 0.68.

(iii) All other coefficients are taken from ASHRA-E/81.

(iv) The inside room temperature is 70° F. and there is 4 inches of SM Blue insulation in the cavity for a total "R" equal to 22.63 (Imperial Units).

The estimates are not as accurate as an overall "R" value estimate. This is because of the difficulty of accurately estimating the inside film coefficient. Less than 2% of the heat will be transferred through the steel rods. This is evident in that four 4 inches of insulation the "R" value of 22.67 reduces to 22.63 as a result of the steel bars. These values are not dependent on temperature and therefore have no difference with respect to the temperatures noted.

Condensation as a result of large outside humidity conditions is not a problem since a continuous vapor barrier is expected by the "SM Blue" insulation.

SEQUENCE OF CONSTRUCTION

In constructing a building, the following is a summary of the recommended sequence of construction:

(a) Foundations are poured with dowels 10M at 400 placed in footings 43. The top surface of the footings 43 are provided with keys 44 as shown in FIG. 1. Sleeves are provided to pour the concrete.

(b) The wall panels 11 are aligned on top of the footing 43, one panel at a time. Temporary bracing is provided to keep the panels in place.

(c) Concrete is poured at the joints between the panels to fill the joint and at the sleeves in the footing 43 to fill the footing beam. Pouring of the concrete is terminated only when the concrete starts to overflow the top of the joint. The use of a high slump concrete or a concrete pump is recommended.

(d) The temporary bracing is removed after at least 3 days of pouring the concrete.

(e) The first floor slab is constructed.

(f) Backfill is then provided around the first floor.

(g) Align the second floor wall panels 11 and thereafter steps c and d are repeated. Execute all necessary welding of inserts, bolts, etc. before pouring the concrete at the joints.

Having described my invention, reference should now be had to the following claims.

I claim:

1. A prefabricated panel for a building comprising a pair of spaced opposed elongated molded concrete inner and outer panel elements of the same width and of rectangular shape;

said outer panel element having a length greater than said inner panel element;

a steel wire mesh reinforcing member embedded into and throughout each panel element;

a series of parallel laterally spaced continuous steel rod trusses interposed between and extending at right angles to sid panel elements;

each truss including a pair of parallel spaced elongated steel rods embedded into said panel elements respectively along their length;

a continuous zig-zag steel truss element at its apexes welded to the adjacent rod and embedded into the respective panel elements as a unit construction;

means interconnecting said wire mesh reinforcing members with said truss rods providing a unit reinforcement;

a fiberglass insulating layer overlying and bonded to the interior surface of said outer panel element, and occupying part of the space between said panel elements, the remaining space providing an air barrier zone between said panel elements and adapted to accommodate wiring and plumbing conduits;

an end support concrete flange across one end of the inner panel element extending to said fiberglass layer;

said insulating layer including a series of insulator strips extending the height of the panel and interposed between an adjacent pair of trusses and bonded thereto;

said bond including a resin applied to the edges of said insulator strip for registry with corresponding portions of said trusses; and top and bottom end connector rods on each truss extending at right angles to and interconnecting the respective ends of said pair of steel rods;

said top end connector rod extending through and reinforcing said concrete flange;

the other end of said inner panel element being in the same plane as the corresponding end of said outer panel element;

said outer panel element extending above said end support flange.

2. In the prefabricated panel of claim 1, there being a pair of said panels closely spaced and laterally aligned, forming part of the building wall;

upright laterally spaced laths snugly interposed between and at right angles to said panel elements, inwardly of the outer edges of each panel defining a chamber between said laths;

and a panel connector column of concrete material poured in situ between said laths when cured into connecting said panels and panel elements throughout their height;

the outermost parallel trusses of said panels being embedded and anchored within said panel connector column.

3. In the prefabricated panel of claim 1, there being a pair of right angularly related panels having adjacent mitered edges along their length, closely spaced apart and adapted to form the corner of a pair of building walls;

upright spaced right angularly related laths snugly interposed between and at right angles to the panel elements inwardly of the outer edges of each panel;

a corner panel connector column of concrete material poured in situ between said laths, when cured interlocking said corner panels and panel elements throughout their heigh; and the outermost pair of trusses of said corner panels being embedded and anchored within said corner panel connector column.

4. In the prefabricated panel of claim 1, further comprising:

a unit cast flooring having a width corresponding to the width of said panel, at said one end of said inner panel element overlying said end support flange and spaced from the outer panel element of said panel.

5. In a building construction having a plurality of right angularly related enclosing walls mounted upon a footing, each of said walls including a series of laterally aligned closely spaced upright prefabricated panels;

each panel comprising a pair of spaced opposed elongated molded concrete inner and outer panel elements of the same width and of rectangular shape;

said outer panel element of each panel having a length greater than the corresponding inner panel element;

a steel wire mesh reinforcing member embedded into and throughout each panel element;

a series of parallel laterally spaced continuous steel rod trusses interposed between and extending at right angles to said panel elements;

each truss including a pair of parallel spaced elongated steel rods embedded into said panel elements respectively along their length;

a continuous zig-zag steel truss element at its apexes welded to the adjacent rod and embedded into the respective panel elements as a unit construction;

means interconnecting said wire mesh reinforcing members with said truss rods providing a unit reinforcement;

a fiberglass insulating layer overlying and bonded to the interior surface of said outer panel element, and occupying part of the space between said panel elements, the remaining space providing an air barrier zone between said panel elements and adapted to accommodate wiring and plumbing conduits;

an end support concrete flange across one end of the inner panel element extending to said fiberglass layer;

top and bottom end connector rods on each truss extending at right angles to and interconnecting the respective ends of said pair of steel rods;

said top end connector rod extending through and reinforcing said concrete flange;

the other end of the inner element of each panel being in the same plane as the corresponding end of said outer panel element;

said outer panel element extending above said end support flange;

a longitudinal connector between adjacent edges of adjacent aligned panels including upright laterally spaced laths snugly interposed between and at right angles to said panel elements, inwardly of the outer edges of each panel defining a chamber between said laths;

a panel connector column of concrete material poured in situ between said laths, and when cured interconnecting said panels and panel elements throughout their height;

a longitudinal connector between adjacent edges of a pair of right angularly related panels for each corner of a building;

each pair of right angularly related panels having adjacent mitered edges along their length, closely spced apart and adapted to form a corner for a pair of building walls;

upright spaced right angularly related laths snugly interposed between and at right angles to the panel elements, inwardly of the outer edges of each panel; and a corner panel connector column of concrete material poured in situ between said laths, and when cured interlocking said corner panels and panel elements throughout their height.

6. A method of making a building panel comprising the following steps:

assembling and interconnecting a series of laterally spaced steel rod trusses between and at right angles to a pair of parallel steel wire mesh reinforcing members, providing a unit panel reinforcement;

mounting and supporting the reinforcement horizontally upon and above an elongated rectangular mold;

pouring a concrete mix into the mold to a depth to enclose one of the steel wire meshes and corresponding adjacent one edge portions of the assembled trusses;

curing for a time sufficient for hardening of the concrete to form a steel reinforced inner panel element with the trusses upon one side along their length and one of the wire reinforcing members embedded and anchored therein;

applying a series of strips of insulating material between each pair of trusses side by side in a plane spaced from the inner panel element;

bonding the longitudinal edges of said strips to adjacent portions of said trusses respectively;

mounting the inner panel element, reinforcement and insulating strips horizontally with the insulating strips temporarily supported to define with a series of connected side walls a second elongated rectangular mold with the planar insulating strips defining the mold bottom;

pouring a concrete mix into the second mold to enclose the adjacent other edge portions of the assembled trusses and of a depth to enclose the other steel wire mesh reinforcing member; and curing for a time sufficient for hardening of the concrete to form a steel reinforced insulated outer panel element, the other side of the trusses along their length and the second steel wire mesh reinforcement being embedded and anchored therein and providing a unit building panel.

* * * * *